United States Patent [19]

Brooks

[11] 4,159,045

[45] Jun. 26, 1979

[54] LADDER STANDOFF PLATFORM

[76] Inventor: Robert W. Brooks, 19405 Kinloch, Redford, Mich. 48240

[21] Appl. No.: 888,232

[22] Filed: Mar. 20, 1978

[51] Int. Cl.[2] ..... E06C 7/14; E06C 7/48

[52] U.S. Cl. ..... 182/116; 182/129; 182/214

[58] Field of Search ..... 182/214, 129, 229, 107, 182/116, 120, 108; 248/238, 210

[56] References Cited

U.S. PATENT DOCUMENTS

| | | | |
|---|---|---|---|
| 2,722,360 | 11/1955 | Malm | 182/214 |
| 2,798,652 | 7/1957 | Easton | 182/129 |
| 3,182,749 | 5/1965 | Girardello | 182/214 |
| 3,490,558 | 1/1970 | Foley | 182/129 |
| 3,568,801 | 3/1977 | Werner | 182/214 |

*Primary Examiner*—Reinaldo P. Machado
*Attorney, Agent, or Firm*—Robert G. Mentag

[57] ABSTRACT

A ladder standoff platform for use on the upper end of straight ladders. The ladder platform includes a flat table portion for supporting tools and other equipment. The table portion is provided with flanges around the periphery thereof for retaining tools or other equipment on the table platform. A pair of tubular members are fixed to the rear outer side corners of the table portion for slidably mounting the platform over the upper ends of the rails of a straight ladder, and for resting against the upper rung of the ladder. A resilient bumper strip is provided along the front end of the platform for engagement with a building against which the ladder is mounted.

7 Claims, 10 Drawing Figures

LADDER STANDOFF PLATFORM

BACKGROUND OF THE INVENTION

1. Field of the Invention

This invention relates to the ladder art, and more particularly, to a novel and improved ladder standoff platform. The invention is specifically concerned with a ladder standoff platform for offsetting the upper end of a straight ladder away from the face of a building against which the ladder is mounted, and for supporting tools and other equipment, such as paint pails.

2. Description of the Prior Art

It is well known in the ladder art to employ ladder standoff platforms for supporting tools and the like, and for positioning the upper end of a straight ladder in an offset position away from the face of a building against which the ladder is mounted. A disadvantage of the prior art ladder support platforms is that they are complex and expensive to make, and time consuming in attaching the platform to a ladder. All prior art ladder platforms employ various types of attachment screws and the like which must be individually fastened to the rails of a ladder. Examples of such prior art ladder platforms are illustrated in U.S. Pat. Nos. 2,732,264, 2,806,642 and 3,182,749. Further examples of complicated and expensive ladder platforms are illustrated in U.S. Pat. Nos. 548,111, 2,749,008, 2,803,389, 3,028,929, 3,288,249, 2,734,236 and 3,762,500.

Another disadvantage of some prior art ladder standoff platforms is that the load transmitted to the ladder from the platform is taken up by one or more rungs on the ladder, and such structure does not provide optimum safety conditions.

SUMMARY OF THE INVENTION

In accordance with the present invention, the ladder standoff platform comprises a flat table portion for supporting tools and other equipment. The table portion is provided with a raised border rail means, which may be formed by mounting angle irons or T-bars around the periphery of the table portion. The table portion is preferably rectangular in plan view, and it may be made from any suitable material, such as wood, glass, aluminum, steel, and so forth. The border rail means may also be made of the same material as the table portion, or from a different material. A pair of tubular or sleeve members are fixed to the rear outer side corners of the table portion for quick and easy mounting of the platform in a slidable manner over the upper ends of the rails of the ladder, and for resting against the upper rung of the ladder. A resilient bumper strip is provided along the front end of the platform for engagement with a building against which the ladder is mounted. The bumper member may be made from rubber, or any other suitable resilient material.

The tubular members may be adjustably mounted on the table portion, for adjusting the center line distance between the tubular members, for mounting the platform on straight ladders of different widths. The standoff platform may be coated with any suitable material, to prevent or lessen conductivity, as for example, it may be dipped in rubber or some type of plastic. A tubular retainer member is mounted on the lower, rear side of the table portion for releasably securing the platform to the ladder, for retaining the same in place against any accidental sliding off action of the platform from the ladder.

The ladder standoff platform of the present invention is not a scaffold or a platform for supporting the weight of a person, but it is only intended for holding or standing off a straight ladder from a building, and to support light tools, pails of paint, and the like. It is adapted for various uses, such as for window washing, working on the side of a building, working on the gutters of a building, putting up storm windows, and so forth. The platform may be positioned under the gutters of a building, or over the gutters and against the sloping rail of a building.

The ladder standoff platform of the present invention is a nonloading, minimum stress applying device which is used to offset the upper end of a ladder away from the face of a building, without applying stress to the upper rung of the ladder.

The ladder standoff platform of the present invention meets the standards of the Occupancy Safety and Health Administration, Department of Labor, which requires that any attachments to a ladder must be on the rails of the ladder. In use, the upper rung of a ladder only acts as a stop member for the sleeve or tubular members of the platform on the rails, any stress on the platform is passed directly to the ladder rails, because of the pivoting action and close clearance of the sleeve or tubular members on the ladder rails.

In use, the weight of a person on the ladder is directed downwardly on the ladder rung on which the person is standing, and very little of that weight is applied to the platform or to the building face against which the platform is engaged.

Other objects, features and advantages of this invention will become apparent from the following detailed description, appended claims, and the accompanying drawings.

DESCRIPTION OF THE PREFERRED EMBODIMENTS

Figure 1:
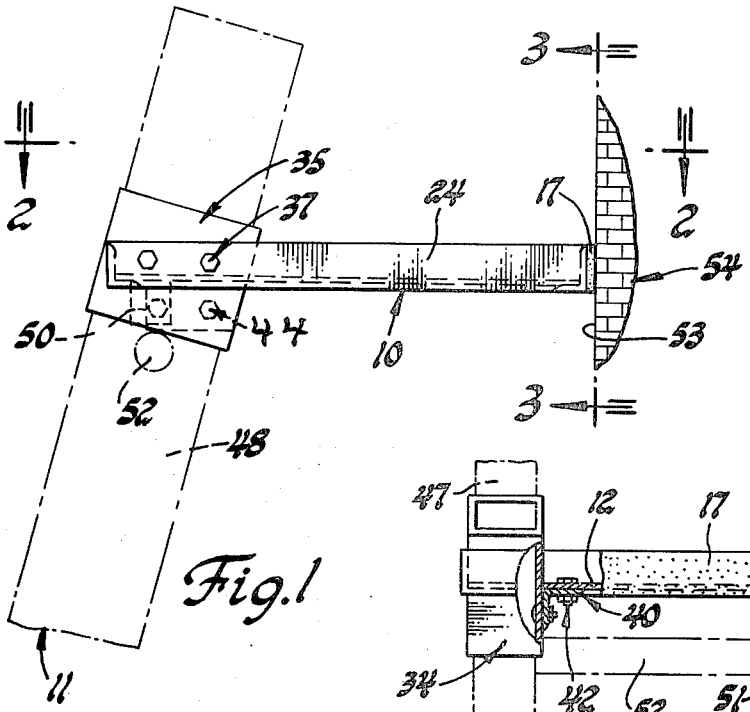
FIG. 1 is a side elevation view of a first embodiment of a ladder standoff platform made in accordance with the principles of the present invention.
Figure 3:
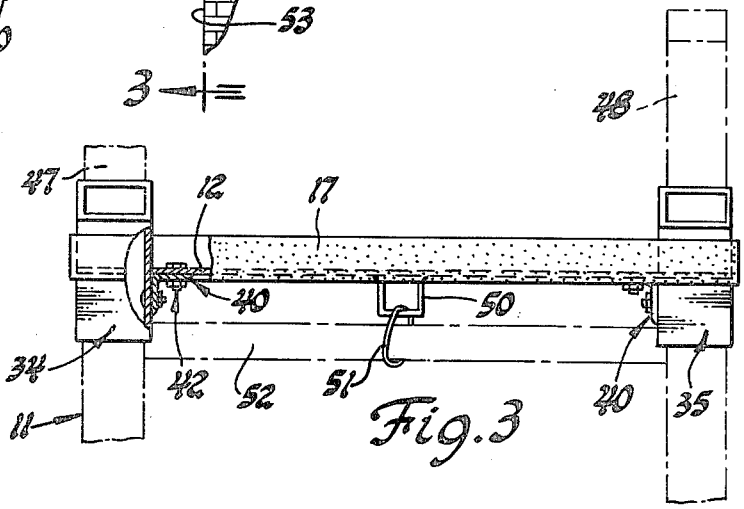
FIG. 3 is a front elevation view of the ladder standoff platform illustrated in FIG. 1, taken along the line 3—3 thereof, and looking in the direction of the arrows.
Figure 2:
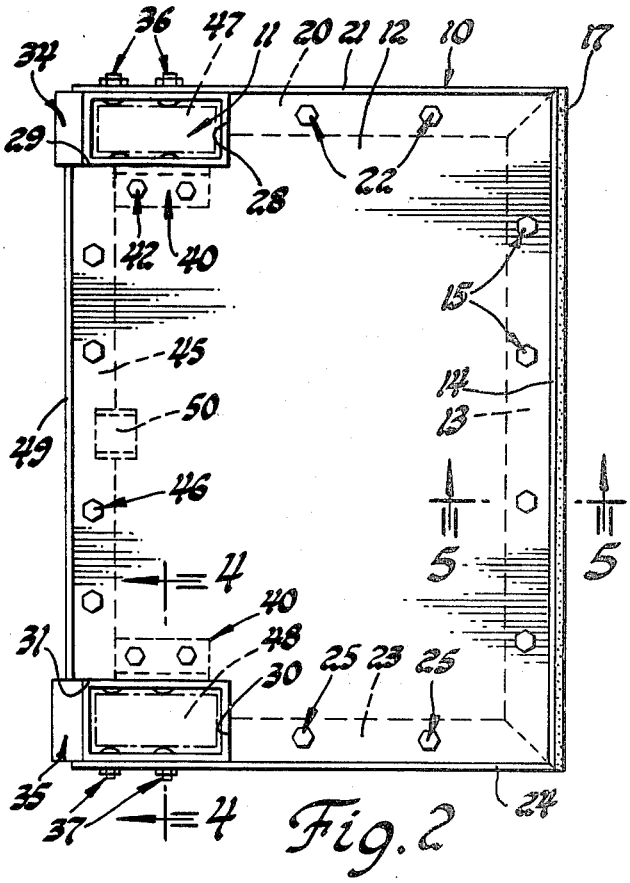
FIG. 2 is a top plan view of the ladder standoff platform illustrated in FIG. 1, taken along the line 2—2 therof, and looking in the direction of the arrows.

Referring now to the drawings, and in particular to FIGS. 1 through 5, the numeral 10 generally designates a ladder standoff platform made in accordance with the principles of the present invention, and illustrating a first embodiment of the invention. The numeral 11 generally designates a straight ladder with which the ladder standoff platform of the present invention may be used. As shown in FIG. 2, the ladder standoff platform 10 includes a flat table portion 12 which is substantially rectangular in plan view. The table portion 12 may be made from any suitable material, such as wood, glass, aluminum, steel and so forth. The table portion 12 is provided with the following described border rail means which may also be made of the same material as the table portion, or from a different material. As shown in FIGS. 2 and 3, the ladder standoff platform 10 is provided along its front end with a border rail formed by an angle iron, including a horizontal flange 13 and a vertical flange 14. The flange 13 is disposed under the front end of the table portion 12, and is fixedly secured thereto by any suitable means, as by a plurality of bolt and nut units generally indicated by the numeral 15. A resilient bumper strip 17 is secured to the outer face of the flange 14 by any suitable means, as by a suitable adhesive. The bumper strip 17 may be made from any suitable material, as for example, rubber or any other suitable resilient material.

As viewed from the left side of the ladder when standing on the ladder 11, the left side of the table portion 12 is provided with a border rail formed by an angle iron having a horizontal flange 20 and a vertical flange 21. The flange 20 is seated under the left side of the table portion 12 and is secured thereto by any suitable means, as by suitable bolt and nut units generally indicated by the numeral 22. Similarly, the right side of the table portion 12 is provided with a border rail comprising an angle iron having a horizontal flange 23 and a vertical flange 24. The horizontal flange 23 is seated against the underside of the table portion 12 and is secured thereto by any suitable means, as by a plurality of suitable bolt and nut units generally indicated by the numeral 25.

As shown in FIG. 2, the rear end corners of the table portion 12 have rectangular cut-off portions, the borders of which are indicated by the numerals 28 and 29 on the left side of the table portion 12, and the numerals 30 and 31 on the right side of the table portion 12. A sleeve or tubular member 34 is seated in the cut-out on the left side of the table portion 12 and a similar sleeve or tubular member 35 is seated in the cut-out on the right side of the table portion 12. The tubular members 34 and 35 are rectangular in cross section and may be made from any suitable material, as for example from tubular aluminum members having a rectangular cross section.

As shown in FIG. 2, the tubular member 34 is secured to the angle bar flange 21 by a pair of suitable bolt and nut units 36. It will be understood that the flange 20 of the angle bar along the left side of the table portion 12 will be removed at the cut-out line 28 rearwardly to the end of the vertical flange 21 leaving only the flange 21 for attachment to the outer side of the tubular member 34. The tubular member 35 is similarly secured in its cut-out position in the table portion 12, and is secured to the angle bar flange 24 by suitable bolt and nut means 37.

Figure 4:
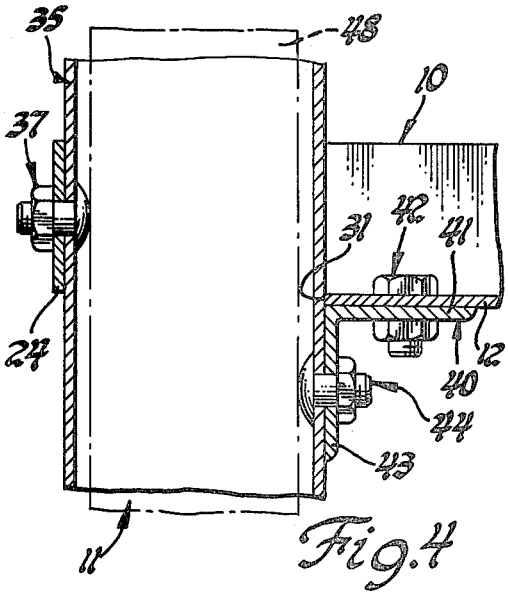
FIG. 4 is a fragmentary, enlarged, elevation section view of the ladder standoff platform illustrated in FIG. 2, taken along the line 4—4 thereof, and looking in the direction of the arrows.
Figure 5:
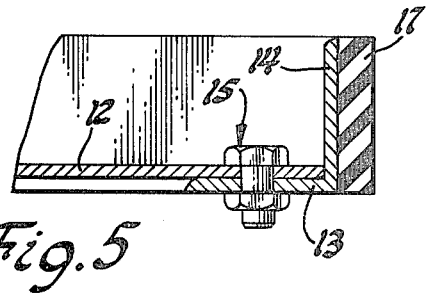
FIG. 5 is a fragmentary, enlarged, elevation section view of the ladder standoff platform illustrated in FIG. 2, taken along the line 5—5 thereof, and looking in the direction of the arrows.
Figure 6:
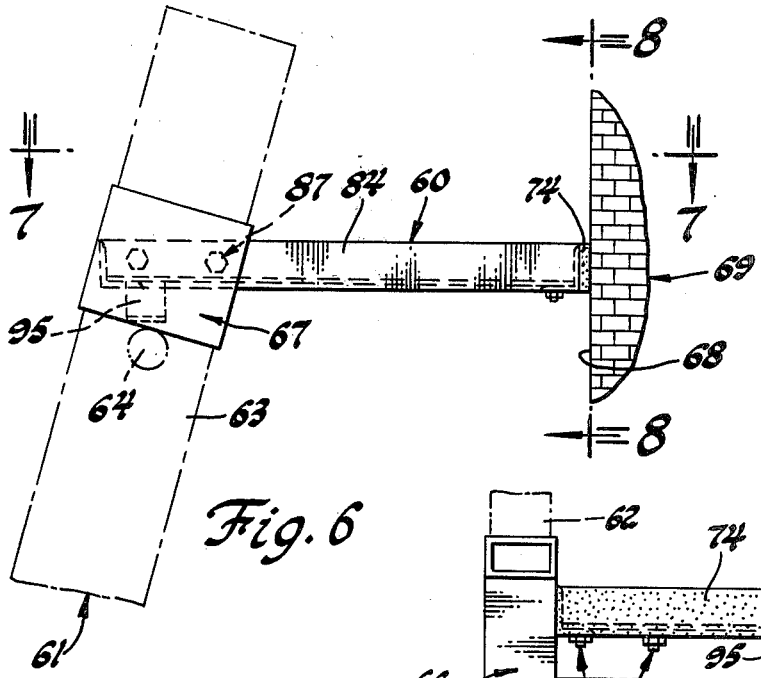
FIG. 6 is a side elevation view of a second embodiment of a ladder standoff platform made in accordance with the principles of the present invention.

As best seen in FIGS. 2, 3 and 4, the tubular members 34 and 35 are also attached to the table portion 12 by a pair of angle bars generally indicated by the numeral 40. Each of the angle bars 40 is secured to its respective tubular member by the same structure. The details of the securing of the angle bar 40 to the tubular member 35 is illustrated in FIG. 4, and the same structure is employed for securing the second angle bar 40 to the tubular member 34. As shown in FIG. 4, the angle bar 40 includes a horizontal flange 41 which is secured by a suitable bolt and nut unit, generally indicated by the numeral 42 to the table portion 12. The vertical flange of the angle bar 40 is secured to the inner wall of the tubular member 35 by a plurality of suitable bolt and nut units 44.

As shown in FIG. 2, the border rail means along the rear end of the table portion 12 is formed by an angle bar having a horizontal flange 45 and an integral vertical flange 49. The horizontal flange 45 is seated against the lower face of the table portion 12, and is secured thereto by a plurality of suitable bolt and nut units generally indicated by the numeral 46.

As shown in FIGS. 2 and 3, the ladder 11 includes the usual spaced apart rails 47 and 48, and the upper ends of these rails are adapted to be slidably mounted through the tubular members 34 and 35 in a close fitting and sliding relationship for mounting the ladder standoff platform 10 on the ladder 11. As best seen in FIG. 3, a U-shaped retainer bracket 50 is secured to the underside of the table portion 12 adjacent the rear end thereof, for positioning over the upper rung 52 of the ladder 11. As shown in FIG. 1, the tubular members 34 and 35 rest on the upper ladder rung 52. The retainer member 50 may be secured to the upper rung 52 by any suitable means, as by a suitable strap 51 which may be of any form and made from any suitable material.

In use, the ladder standoff platform 10 may be quickly and easily mounted on a ladder 11 by sliding the tubular members 34 and 35 over the upper ends of the ladder rails 47 and 48 when the ladder is in a horizontal position on the ground. The straps 51 may then be attached to the retainer member 50 to retain the ladder standoff platform 10 in the working position when the ladder is moved. The ladder 11 is then extended upwardly into a working position with the front resilient member 17 positioned against the surface 53 of the building generally indicated by the numeral 54 in FIG. 1. It will be understood that if the ladder is extended upwardly far enough that the outer end of the platform 10 may also be positioned on the building above the gutter along the side of the building, with the outer end resting on the sloping roof of the building. It will be understood that the standoff platform 10 may be dipped in rubber or some sort of plastic, if desired, to prevent or lessen conductivity.

Figure 7:
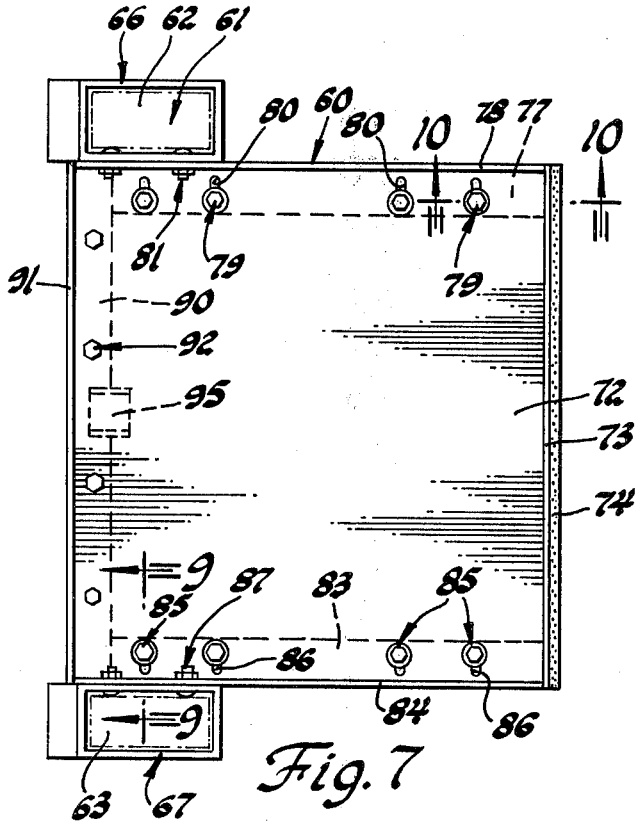
FIG. 7 is a top plan view of the ladder standoff platform illustrated in FIG. 6, taken along the line 7—7 thereof, and looking in the direction of the arrows.
Figure 9:
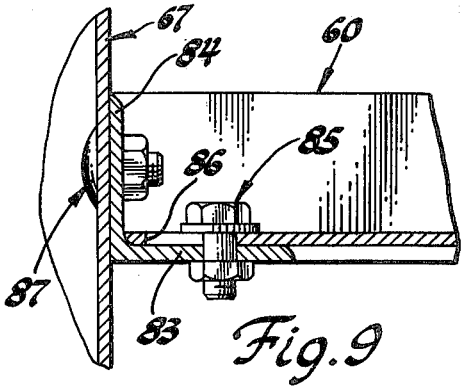
FIG. 9 is a fragmentary, enlarged, elevation view of the ladder standoff platform illustrated in FIG. 7, taken along the line 9—9 thereof, and looking in the direction of the arrows.

FIGS. 6 through 10 illustrate a second embodiment of the invention wherein the numeral 60 generally designates the ladder standoff platform comprising the second embodiment. The numeral 61 generally designates a straight ladder on which the platform 60 is mounted. As shown in FIG. 7, the straight ladder 61 is illustrated as including a pair of laterally spaced apart side rails 62 and 63 and an upper rung 64. The platform 10 is provided with a pair of sleeves or tubular members 66 and 67 at the left and right rear end corners respectively, as shown in FIG. 7. The platform 60 is adapted to be used in the same manner as previously described hereinbefore for the first embodiment of FIGS. 1 through 6 by having the outer front end positioned against a building indicated generally by the numeral 69 in FIG. 6, and against the upper side 68.

As shown in FIG. 7, the platform 60 includes a table portion 72 which is substantially rectangular in plan view. The table portion 72 is provided with a suitable border rail means around the periphery thereof. It will be understood that the table 60 may be made from the same materials as described hereinbefore for the first embodiment.

Figure 10:
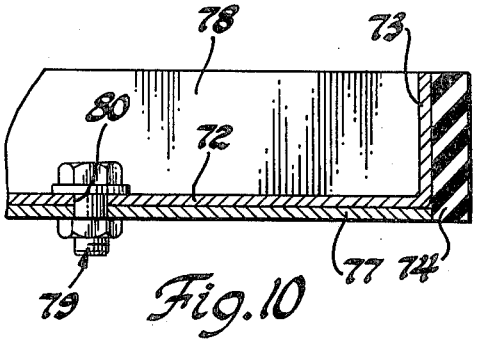
FIG. 10 is a fragmentary, enlarged, elevation section view of the ladder standoff platform illustrated in FIG. 7, taken along the line 10—10 thereof, and looking in the direction of the arrows.

As shown in FIGS. 7 and 10, the table portion 72 is provided along the front outer end thereof with an integral upturned or vertical flange 73, which has mounted on its outer face a bumper member indicated by the numeral 74. The bumper member 74 may be made from rubber or any other suitable resilient material, and is adhered to the flange 73 by any suitable means, as by a suitable adhesive. The table portion 72 is provided along the left side thereof, as viewed from a position standing on the ladder 61, with a border rail means formed by an adjustably mounted angle bar comprising a horizontal flange 77 and a vertical flange 78. The flange 77 is seated on the underside of the table portion 72, along the left side thereof, and it is secured thereto by a plurality of suitable bolt and nut units generally indicated by the numeral 79. The bolt and nut units 79 are mounted through suitable holes in the flange 77 and suitable slots 80 in the table portion 72. As shown in FIG. 7, the tubular member 66 is secured by a plurality of suitable bolt and nut units 81 to the rear outer end of the vertical flange 78. The table portion 72 is provided with a similar border rail means along the right side thereof. An angle bar having a horizontal flange 83 and a vertical flange 84 is adjustably mounted along the right side of the table portion 82 and it is secured thereto by a plurality of suitable bolt and nut units 85. The bolt and nut units 85 are passed through a suitable hole in the horizontal flange 83 and slot 86 formed through the table portion 72, and is shown in detail in FIG. 9. The tubular member 67 is secured by a pair of suitable bolt and nut units 87 to the outer rear end of the vertical flange 84. It will be seen that the tubular members 66 and 67 may be adjusted sidewardly outward to adjust the center-line distance between the center points of the tubular member 66 and 67 for mounting the platform 60 on ladders having different center distances between the centers of their rails, such as between the centers of the rails 62 and 63.

Figure 8:
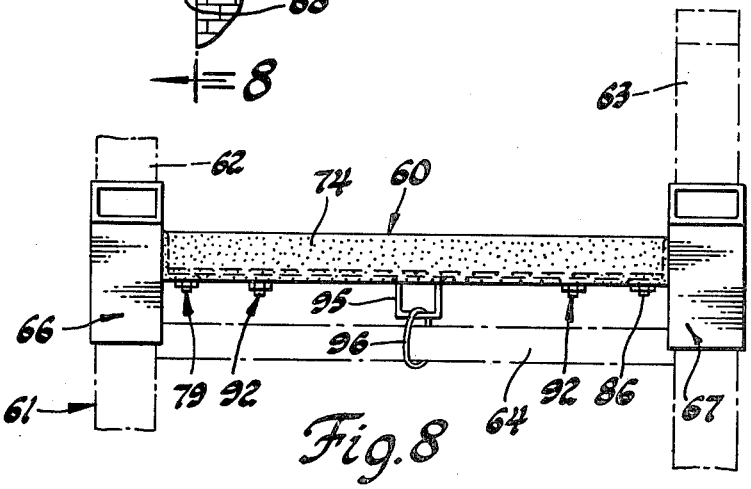
FIG. 8 is a front elevation view of the ladder standoff platform illustrated in FIG. 6, taken along the line 8—8 thereof, and looking in the direction of the arrows.

The platform 60 is provided along the rear end thereof with a border rail formed by an angle bar having a horizontal flange 90 and a vertical flange 91. The horizontal flange 90 is positioned under the table portion 72 and it is secured thereto by any suitable means as by a plurality of suitable bolt and nut ends generally indicated by the numerals 92. As shown in FIG. 8, the platform 60 is provided with a U-shaped retainer bracket 95 which is secured by any suitable means to the underside of the table portion 72 at the rear end thereof. The retainer bracket 95 may be secured to the upper rung of a ladder by any suitable means, as by a suitable retainer strap 96 to prevent the platform 60 from being accidentally removed from the ladder 61.

The platform 60 of the second embodiment of FIGS. 6 through 10 is used in the same manner as previously described for the first embodiment of FIGS. 1 through 5.

While it will be apparent that the preferred embodiments of the invention herein disclosed are well calculated to fulfill the objects above stated, it will be appreciated that the invention is susceptible to modification, variation and change.

What is claimed is:

1. In a support platform for straight ladders having two side rails and a plurality of transverse rungs, including an upper rung, interconnecting said rails, the combination comprising:
   (a) a flat table portion having a front end, for resting engagement against a building when the ladder is vertically disposed against a building, and a rear end;
   (b) a tubular member secured at each side of the rear end of the flat table portion in spaced apart relationship equal to the spacing of the side rails of a ladder for slidably mounting the tubular members over the upper ends of the side rails in close slidable relation therewith, and downward into seating engagement against the upper one of said transverse rungs, for mounting the support platform on the side rails of a straight ladder.

2. A support platform for ladders having two side rails as defined in claim 1, wherein:
   (a) said flat table portion is provided with raised border rails.

3. A support platform for ladders having two side rails as defined in claim 2, wherein:
   (a) said border rails extend along the periphery of said flat table portion.

4. A support platform for ladders having two side rails as defined in claim 3, wherein:
   (a) said tubular members are fixedly mounted on the flat table portion.

5. A support platform for ladders having two side rails as defined in claim 3, wherein:
   (a) said tubular members are adjustably mounted on the flat table portion.

6. A support platform for ladders having two side rails as defined in claim 3, including:
   (a) a resilient bumper member attached to the front end of the flat table portion.

7. A support platform for ladders having two side rails as defined in claim 2, including:
   (a) a retainer member mounted on the lower side of the flat table portion adjacent the rear end thereof for attachment to the upper rung of a ladder.

* * * * *

UNITED STATES PATENT OFFICE

CERTIFICATE OF CORRECTION

Patent No. 4,159,045 Dated June 26, 1979

Inventor(s) Robert W. Brooks

It is certified that error appears in the above-identified patent and that said Letters Patent are hereby corrected as shown below:

Column 1, line 29, - "2,734,236" should be --3,734,236.

Signed and Sealed this

*Eleventh* Day of *September 1979*

[SEAL]

*Attest:*

*Attesting Officer*

LUTRELLE F. PARKER

*Acting Commissioner of Patents and Trademarks*